US007882894B2

(12) United States Patent
Nguyen et al.

(10) Patent No.: US 7,882,894 B2
(45) Date of Patent: Feb. 8, 2011

(54) METHODS FOR COMPLETING AND STIMULATING A WELL BORE

(75) Inventors: Philip D. Nguyen, Duncan, OK (US); Ronald G. Dusterhoft, Katy, TX (US); Loyd East, Tomball, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 157 days.

(21) Appl. No.: 12/378,932

(22) Filed: Feb. 20, 2009

(65) Prior Publication Data

US 2010/0212897 A1 Aug. 26, 2010

(51) Int. Cl.
*E21B 43/26* (2006.01)

(52) U.S. Cl. ..... 166/280.2; 166/295; 166/308.1

(58) Field of Classification Search ..... 166/280.1, 166/280.2, 295, 308.1
See application file for complete search history.

(56) References Cited

U.S. PATENT DOCUMENTS

| | | | | |
|---|---|---|---|---|
| 3,845,815 | A | 11/1974 | Garwood | 166/154 |
| 5,058,676 | A * | 10/1991 | Fitzpatrick et al. | 166/278 |
| 5,211,234 | A * | 5/1993 | Floyd | 166/276 |
| 5,597,043 | A * | 1/1997 | Stadulis | 166/280.1 |
| 5,765,642 | A | 6/1998 | Surjaatmadja | 166/297 |
| 5,813,463 | A * | 9/1998 | Stadulis | 166/280.1 |
| 6,732,800 | B2 * | 5/2004 | Acock et al. | 166/308.1 |
| 7,225,869 | B2 | 6/2007 | Willett et al. | 166/280.1 |
| 7,273,099 | B2 | 9/2007 | East, Jr. et al. | 166/280.1 |
| 7,343,975 | B2 | 3/2008 | Surjaatmadja et al. | 166/297 |
| 7,398,825 | B2 | 7/2008 | Nguyen et al. | 166/280.1 |
| 7,478,676 | B2 | 1/2009 | East, Jr. et al. | 166/305.1 |
| 7,644,761 | B1 * | 1/2010 | Gu et al. | 166/280.1 |
| 7,798,227 | B2 * | 9/2010 | Misselbrook | 166/308.1 |
| 2006/0000610 | A1 | 1/2006 | Farabee et al. | 166/281 |
| 2008/0110622 | A1 | 5/2008 | Willett et al. | 166/280.2 |
| 2008/0156496 | A1 | 7/2008 | East | 166/313 |
| 2008/0179060 | A1 | 7/2008 | Surjaatmadja et al. | 166/298 |
| 2010/0155065 | A1 * | 6/2010 | Misselbrook | 166/280.1 |

OTHER PUBLICATIONS

Halliburton brochure entitled "Hydra-Jet$^{SM}$ Perforating Process Service", 2006.
Halliburton brochure entitled "CobraMax$^{SM}$ Fracturing Service", 2005.
Halliburton brochure entitled "Delta Stim™ Sleeve", 2006.

* cited by examiner

*Primary Examiner*—William P Neuder
(74) *Attorney, Agent, or Firm*—Robert A. Kent; McDermott Will & Emery LLP

(57) ABSTRACT

Methods are providing, including methods comprising providing a liner disposed within a well bore that penetrates a subterranean formation, such that the well bore comprises an annular space between the exterior surface of the liner and the well bore wall; providing a jetting tool disposed within the liner; introducing a stimulation fluid to a treatment interval of the well bore via the jetting tool, such that the stimulation fluid is introduced with sufficient pressure to create or enhance a plurality of perforations in the liner in the treatment interval; introducing a proppant slurry comprising a plurality of resin-coated particulates to the treatment interval of the well bore; and allowing the resin-coated particulates to fill at least a portion of the liner in the treatment interval and at least a portion of the annular space in the treatment interval.

18 Claims, 4 Drawing Sheets

METHODS FOR COMPLETING AND STIMULATING A WELL BORE

BACKGROUND

The present invention relates generally to subterranean treatment operations, and more particularly to methods of completing and stimulating a well bore.

In the oil and gas industry, a common step in the completion of a well bore is to cement pipe strings, such as casings and liners, in the well bore. Generally, a well bore is drilled and a pipe string is inserted into the well bore. A cement composition is then pumped into the annular space between the walls of the well bore and the exterior surface of a pipe string disposed therein. The cement composition is permitted to set in the annular space, thereby forming an annular sheath of hardened, substantially impermeable cement that substantially supports and positions the pipe string in the well bore, and that bonds the exterior surface of the pipe string to the walls of the well bore. Cements that are typically used in subterranean cementing operations are substantially impermeable, in all areas outside of the perforated interval.

After a well bore has been drilled and the pipe string has been cemented, it is also common to perform one or more subsequent completion and/or stimulation operations, including, but not limited to, hydraulic fracturing and sand control treatments. Hydraulic fracturing operations generally involve pumping a treatment fluid (e.g., a fracturing fluid) into a well bore that penetrates a subterranean formation at a sufficient hydraulic pressure to create or enhance one or more cracks, or fractures, in the subterranean formation. "Enhancing" one or more fractures in a subterranean formation, as that term is used herein, is defined to include the extension or enlargement of one or more natural or previously created fractures in the subterranean formation. The treatment fluid may comprise particulates, often referred to as proppant particulates, that are deposited in the fractures. The proppant particulates, inter alia, may prevent the fractures from fully closing upon the release of hydraulic pressure, forming conductive channels through which fluids may flow to the well bore. The proppant particulates also may be coated with certain types of materials, including resins, tackifying agents, and the like, among other purposes, to enhance conductivity (e.g., fluid flow) through the fractures in which they reside.

One common type of sand control treatment is gravel packing. Typical gravel packing treatments involve suspending particulates (commonly referred to as gravel particulates) in a treatment fluid, and depositing at least a portion of those particulates in a desired area in a well bore, e.g., near unconsolidated or weakly consolidated formation zones, to form a gravel pack. In general, a gravel pack is a grouping of particulates that are packed sufficiently close together so as to prevent the passage of certain materials through the gravel pack. This gravel pack may, inter alia, enhance sand control in the subterranean formation and/or prevent the flow of particulates from an unconsolidated portion of the subterranean formation (e.g., a propped fracture) into a well bore. One common type of gravel-packing operation involves placing a sand control screen in the well bore and packing the annulus between the screen and the well bore with the gravel particulates of a specific size designed to prevent the passage of formation sand. The gravel particulates act, inter alia, to prevent the formation sand from occluding the screen or migrating with the produced hydrocarbons, and the screen acts, inter alia, to prevent the particulates from entering the well bore. The gravel particulates may also be coated with certain types of materials, including resins, tackifying agents, and the like, among other purposes, to enhance conductivity (e.g., fluid flow) through the gravel pack in which they reside. In some situations, fracturing and gravel-packing treatments are combined into a single treatment. These combined treatments may be commercially available under the trade name FRAC PAC™ from Halliburton Energy Services, Inc. of Duncan, Okla. In such combined treatments, the treatments are generally completed with a gravel pack screen assembly in place with the hydraulic fracturing treatment being pumped through the annular space between the casing and screen. In this situation, the hydraulic fracturing treatment ends in a screen-out condition, creating an annular gravel pack between the screen and casing. In other cases, the fracturing treatment may be performed prior to installing the screen and placing a gravel pack.

In traditional well bores, installing and cementing pipe strings, as well as performing subsequent operations such as hydraulic fracturing and sand control treatments, may be costly and time consuming. The cost and complexity of traditional completion, stimulation, and sand control techniques, including installing casings, performing cementing, installing sand control screens and performing gravel packing, may be even greater in slim hole well bores. As used herein, the term "slim hole well bore" refers to a well bore that is about five inches in diameter or less. Slim hole well bores may be substantially vertical, high deviated, or horizontal. In some hydrocarbon recovery operations it may be preferable to drill a slim hole well bore rather than a traditional well bore. Among the many potential advantages of drilling a slim hole well bore are the typically shorter drilling times, the ability to use less-bulky drilling equipment, the creation of fewer drill cuttings, and the reduced drill cutting disposal costs arising from the reduction in drill cuttings. In some cases, the cost savings associated with drilling a slim hole well bore may be negated by the increased cost of cementing the slim hole well bore. As a result, some sections of a well bore may be left in an openhole condition. As used herein, the term "openhole" refers to a well bore that comprises at least one section that does not comprise a casing string. The term "openhole section" is used herein to refer to a section of a well bore that does not comprise a cemented casing string. At times, an openhole well bore may comprise an openhole section that is completed with stand-alone screen completions using slotted liners, wire-wrapped screens, premium screens, or expandable screens in addition to the use of gravel pack completions.

Because of well bore size restriction, performing gravel packing or frac-packing completions in slim holes may be challenging and costly. Frequently, open holes of long horizontal well bores, even those of conventional bore sizes (not slim holes), are completed with sand alone screens because of cost and complexity involved with gravel packing or other sand control methods.

SUMMARY

The present invention relates generally to subterranean treatment operations, and more particularly to methods of completing and stimulating a well bore.

Some embodiments of the methods provided comprise: (a) providing a liner disposed within a well bore that penetrates a subterranean formation, such that the well bore comprises an annular space between the exterior surface of the liner and the well bore wall; (b) providing a jetting tool disposed within the liner; (c) introducing a stimulation fluid to a treatment interval of the well bore via the jetting tool, such that the stimulation fluid is introduced with sufficient pressure to create or enhance a plurality of perforations in the liner in the treatment interval; (d) introducing a proppant slurry comprising a plurality of resin-coated particulates to the treatment interval of the well bore; and (e) allowing the resin-coated particulates to fill at least a portion of the liner in the treatment interval and at least a portion of the annular space in the treatment interval.

Further, some embodiments of the methods provided comprise: (a) providing a liner disposed within a well bore that penetrates a subterranean formation, such that the well bore comprises an annular space between the exterior surface of the liner and the well bore wall; (b) providing a jetting tool disposed within the liner; (c) introducing a stimulation fluid to a treatment interval of the well bore via the jetting tool, such that the stimulation fluid is introduced with sufficient pressure to create or enhance a plurality of perforations in the liner in the treatment interval; (d) introducing a proppant slurry comprising a plurality of resin-coated particulates to the treatment interval of the well bore; and (e) allowing the resin-coated particulates to fill at least a portion of the liner in the treatment interval and at least a portion of the annular space in the treatment interval; (f) allowing the resin-coated proppant particulates in the interior of the liner to at least partially consolidate into a proppant pack; and (g) using a drill bit to drill through the resin-coated proppant particulates in the interior of the liner.

In addition, some embodiments of the methods provided comprise: (a) providing a liner that comprises sliding sleeves and that is disposed within a well bore that penetrates a subterranean formation, such that the well bore comprises an annular space between the exterior surface of the liner and the well bore wall; (b) shifting a sliding sleeve in a treatment interval of the well bore into an open position so that the interior of the liner is in fluid communication with the annular space through a first set of ports in the liner; (c) introducing a proppant slurry comprising a plurality of resin-coated particulates to the treatment interval of the well bore; and (d) allowing the resin-coated particulates to fill at least a portion of the liner in the treatment interval and at least a portion of the annular space in the treatment interval.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

Figure 1:
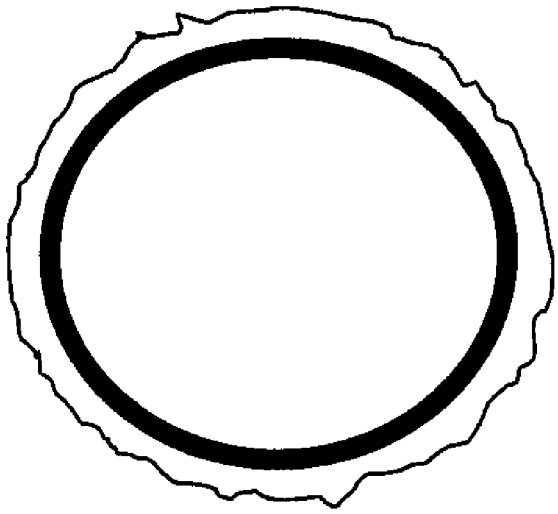
FIG. 1 illustrates a lateral cross section of a well bore (the outer circle) with a liner (the inner circle) disposed therein in accordance with some embodiments of the present invention.

The present invention relates generally to subterranean treatment operations, and more particularly to methods of completing and stimulating a well bore.

In some embodiments, the methods of the present invention may comprise completion and/or stimulation methods for use in an openhole section of a well bore, e.g., a section of a well bore that does not comprise a cemented casing string. Of the many potential advantages of the methods of the present invention, one advantage may be that in some embodiments, the methods of the present invention may be an economical alternative to conventional cementing techniques, especially when used in slim hole well bores. Methods of the present invention may also be of great advantage in cases where they provide for formation stimulation and at the same time allow well bore stabilization and sand control in weakly consolidated formations. Other potential advantages may include, inter alia, improved well bore integrity, formation stimulation, and/or improved sand control in weakly consolidated formations. Another advantage of some embodiments of the present invention may be that, unlike the cement that is traditionally used to cement casing strings in place, the proppant pack that is created outside of the well bore liner may be both permeable and strong. Permeability of the proppant pack in an openhole section of a well bore may be desirable because it may allow production fluids to flow into a well bore along the entire length of an openhole section.

In some embodiments, the present invention provides methods comprising providing a liner disposed within a well bore that penetrates a subterranean formation, such that the well bore comprises an annular space between the exterior surface of the liner and the well bore wall; providing a jetting tool disposed within the liner; introducing a stimulation fluid to a treatment interval of the well bore via the jetting tool, such that the stimulation fluid is introduced with sufficient pressure to create or enhance a plurality of perforations in the liner in the treatment interval and extend the depth of the penetration to create fractures inside the formation; introducing a proppant slurry comprising a plurality of resin-coated proppant particulates to the treatment interval of the well bore; and allowing the resin-coated proppant particulates to fill at least a portion of the liner in the treatment interval and at least a portion of the annular space in the treatment interval.

Subterranean formations which may be treated in accordance with the present invention include, but are not limited to, subterranean formations penetrated by a well bore comprising one or more openhole sections, i.e., sections of the well bore that do not contain a cemented casing string. According to some embodiments of the present invention, an openhole section of a well bore may comprise an uncemented liner. One difference between a cemented casing string and an uncemented liner is that a cemented casing string is installed during drilling of a well bore and is then cemented into place, whereas an uncemented liner is installed in an open hole section of a well bore after the drilling process is completed. The open hole section is often completed with gravel packing or frac-packing completions, or with stand-alone screens completions using slotted liners, wire-wrapped screens, premium screens, or expandable screens. In certain exemplary embodiments, the liner may be positioned in an openhole section of the well bore so that a least a portion of an outer annulus is created. As used herein, the term "outer annulus" refers to an annular space defined by the exterior surface of the liner and the well bore wall. According to some embodiments of the present invention, the liner may be centralized or partially centralized with respect to the diameter of the well bore. As will be appreciated by those of ordinary skill in the art, a liner may be centralized using a device known as a centralizing tool. In some embodiments, the liner may be centralized to provide or to more evenly distribute an outer annulus between the exterior surface of the liner and the well bore wall.

Well bore liners that may be suitable for use in the methods of the present invention may include solid liners (e.g., unperforated liners), pre-perforated liners, and slotted liners. In some embodiments of the present invention, a liner may be pre-perforated or slotted, meaning that the liner, as provided, comprises a plurality of perforations. As used herein, the term "perforations" encompasses openings or fissures in the liner that allow fluid communication between the interior of the liner and the outer annulus. In other embodiments, the liner may be provided as a solid liner, e.g., a liner without perforations. A person of ordinary skill in the art will appreciate which type of liner is appropriate for the conditions of a particular well. In certain embodiments, the liner may comprise jets on the outer surface of the liner. The jetted liner may be connected to a conduit through which fluids may be supplied to the jets on the liner.

In certain embodiments, a jetting tool is disposed within the liner. The jetting tool may be a hydrajetting tool of the type that may be used in SURGIFRAC™ fracturing services, often commercially referred to as Hydrajet Fracturing services. In such an embodiment, the jetting tool typically comprises a plurality of fluid jet forming nozzles which are disposed in a single plane aligned with the plane of maximum principal stress in the subterranean formation to be fractured. Such alignment may result in the formation of a single fracture extending outwardly from and around the well bore. In some embodiments, the jetting tool is attached to a conduit. The conduit may be any piece of equipment that provides a defined flow pathway for fluids to or away from the jetting tool, e.g., coiled tubing, drill pipe, etc. In exemplary embodiments, the conduit comprises coiled tubing. In general, the jetting tool may be lowered into the well bore by a conduit which also supplies the jetting tool with the fluid(s) that pass through nozzles positioned on the jetting tool. The jetting tool may be moved in and out of the well bore by the conduit, and is capable of being positioned adjacent to or near treatment intervals where the operator desires the jetting tool to place fluids and create new perforations and/or fractures in a liner and/or the subterranean formation. In some embodiments, the conduit may comprise at least one port (e.g., nozzle or jet), wherein the port is capable of directing the flow of fluid from within the conduit in a desired direction.

According to some embodiments of the present invention, perforations in a well bore liner are created or enhanced, for example, by propelling a stimulation fluid through a jetting tool and at the interior surface of the liner at a pressure sufficient to create or enhance perforations in the liner. The stimulation fluid may comprise any fluid known in the art to be suitable as a perforating fluid. In some embodiments, the stimulation fluid may comprise abrasive materials (e.g., particulate materials such as sand, gravel, degradable and dissolvable particulates, and the like) and a base fluid, which is commonly water. The present invention contemplates that an in situ perforating step may take place whether the liner is provided as a solid, pre-perforated, or slotted liner.

In some embodiments, after a stimulation fluid creates or enhances perforations in the liner, the stimulation fluid or a separate fracturing fluid may be used to create or enhance a fracture that originates in the wall of the well bore and extends into the subterranean formation. In general, a fracture may form if the stimulation fluid or fracturing fluid is introduced to the well bore at a pressure exceeding the fracture pressure of the formation. A fracture will typically form near a location where a perforation already exists in the subterranean formation. Among other things, creating or enhancing fractures may at least partially restore the permeability of a subterranean formation and reconnect the well bore with a portion of the formation (e.g., the reservoir formation) outside the zone being treated.

In some embodiments, the stimulation fluid and/or fracturing fluid may further comprise a proppant that is carried into fractures in the subterranean formation. In some embodiments, a fracturing fluid which is different from the stimulation fluid may be introduced to a treatment interval via the jetting tool that is used to introduce the stimulation fluid. The present invention contemplates that in some embodiments other fracturing methods may also be employed. For example, the subterranean formation may be fractured or perforations in the subterranean formation may be enhanced by pumping a fracturing fluid from the surface through the outer annular space defined by the exterior surface of the liner and the well bore wall. Other fracturing techniques can also be used to fracture a treatment interval. According to some embodiments, initiating a fracture with a jetting tool may be more desirable than conventional fracture-initiating techniques because the use of the jetting tool may allow for a lower break-down pressure on the formation, and/or a more accurate and better quality fracture.

During the perforating and/or fracturing step, the inner annulus may optionally be closed or open to the surface. As used herein, the term "inner annulus" refers to the annular space defined by the inner surface of the liner and the exterior surface of the conduit and/or jetting tool. Those skilled in the art will appreciate when the inner annulus should be closed or open to achieve the proper well bore pressure to perform the perforating and/or fracturing step.

The present invention contemplates that the stimulation fluid, optional fracturing fluid, and/or proppant slurry may be introduced to the well bore in a variety of different ways, sequences, or combinations. In some embodiments, the proppant slurry may be placed in the well bore via the inner annulus between a conduit disposed in the liner and the interior surface of the liner while the flow of another fluid through the conduit is maintained. In certain embodiments in which the stimulation fluid or an optional separate fracturing fluid creates one or more fractures in a treatment interval of the subterranean formation, the flow of the proppant slurry through the inner annulus may begin as soon as one or more fractures are created. In some embodiments, a proppant slurry that flows into the outer annulus of a treatment interval may guide cuttings left in the annulus from the perforating and/or or fracturing steps into fractures in the subterranean formation. The stimulation fluid and the proppant slurry may be placed in the well bore concurrently or in succession.

In some embodiments, the flow of stimulation fluid into a treatment interval may be replaced with the flow of a proppant slurry into the treatment interval. In preferred embodiments, the replacement of the stimulation fluid with the proppant slurry occurs without an appreciable interruption between the placement of the stimulation fluid and the placement of the proppant slurry in the well bore. In some embodiments, a proppant slurry is not introduced into a treatment interval until after the jetting tool has moved up hole and out of the treatment interval. In other embodiments, a proppant slurry is introduced to a treatment interval, possibly at a rate lower than a fracturing operation, before the jetting tool has moved out of the treatment interval. If a proppant slurry is particularly viscous or contains a high concentration of resin-coated particulates, exemplary embodiments may involve moving the jetting tool out of the treatment interval before the proppant slurry is introduced to the treatment interval so that the proppant slurry does not impede the movement of the jetting tool within the well bore.

In some embodiments in which the proppant slurry is introduced via a conduit disposed in the liner, the proppant slurry may also be introduced via the inner annulus defined by the outer surface of the conduit and the inner surface of the liner. In such embodiments, the proppant slurry may comprise two distinct fluids, referred to herein as the "conduit proppant slurry," and the "annulus proppant slurry." The composition of the conduit proppant slurry and the annulus proppant slurry may be similar, although the annulus proppant slurry may contain a higher concentration of proppant particulates than the conduit proppant slurry. Among other things, flowing proppant slurry through both the inner annulus and through a conduit disposed in the liner may provide the largest possible flow path for the proppant slurry, thereby increasing the rate at which the proppant slurry may be forced into the formation. In certain embodiments in which the proppant slurry comprises a conduit proppant slurry and an annulus proppant slurry, the conduit proppant slurry and the annulus proppant slurry may be placed in the well bore at different times, and/or concurrently.

Proppant slurries suitable for use in the present invention generally comprise resin-coated particulates. Particulates may be present in the proppant slurry in an amount ranging from about 2 pounds per gallon of fluid (lbs/gallon) to about 8 pounds per gallon of fluid (lbs/gallon). In preferred embodiments, a proppant slurry that is placed in the well bore via a conduit disposed in the liner may have a particulate concentration of about 2 lbs/gallon to about 4 lbs/gallon. In some embodiments, a proppant slurry that is placed in the well bore via the inner annulus may have a particulate concentration of about 4 lbs/gallon to about 6 lbs/gallon.

Particulates that are suitable for use in the proppant slurries of the present invention may comprise any particulate material known in the art to be suitable for use in subterranean operations. Examples include, but are not limited to, sand, bauxite, ceramic materials, glass materials (e.g., glass beads), polymer materials, TEFLON® materials (i.e., polytetrafluoroethylene materials), nut shell pieces, seed shell pieces, cured resinous particulates comprising nut shell pieces, cured resinous particulates comprising seed shell pieces, fruit pit pieces, cured resinous particulates comprising fruit pit pieces, wood, composite particulates, and combinations thereof. Composite particulates also may be used, wherein suitable composite materials may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, ground nut/seed shells or husks, saw dust, ground cellulose fiber, and combinations thereof. The proppant particulates contained in the proppant slurries are generally of a size such that when the proppant particulates are consolidated together in a cured proppant pack, the proppant pack has substantial strength and rigidity and is permeable to at least the flow of production fluids. Proppant particulates includes in the proppant slurry may comprise particulates with a particle size in the range of about 100 mesh to 8 mesh. Proppant particulate sizes that are desirable for a particular application may vary based on a number of factors, such as formation properties, including permeability, the consolidation level of a rock formation, closure stress, and the like. It should be understood that the term "particulate," as used in this disclosure, includes all known shapes of materials including substantially spherical materials, fibrous materials, polygonal materials (such as cubic materials) and mixtures thereof.

In accordance with the present invention, the particulates (or some portion thereof) that are contained in a proppant slurry are coated with a resin. The term "coated" does not imply any particular degree of coverage of the proppant particulates with the resin. The proppant particulates may be coated by any suitable method as recognized by one skilled in the art with the benefit of this disclosure. In some embodiments, the resin-coated proppant comprises proppant that has been pre-coated by a commercial supplier. Suitable commercially available resin-coated proppant materials include, but are not limited to, pre-cured resin-coated sand, curable resin-coated sand, curable resin-coated ceramics, single-coat, dual-coat, or multi-coat resin-coated sand, ceramic, or bauxite. Some examples available from Borden Chemical, Columbus, Ohio, are "XRTTM CERAMAX P," "CERAMAX I," "CERAMAX P," "ACFRAC BLACK," "ACFRAC CR," "ACFRAC SBC," "ACFRAC SC," and "ACFRAC LTC." Some examples available from Santrol, Fresno, Tex., are "HYPERPROP G2," "DYNAPROP G2," "MAGNAPROP G2," "OPTIPROP G2," "SUPER HS," "SUPER DC," "SUPER LC," and "SUPER HT."

In place of pre-coated proppant particulates, certain embodiments use proppant particulates that are coated with a curable resin on-the-fly at the well site. The term "on-the-fly" is used herein to mean that a flowing stream is continuously introduced into another flowing stream so that the streams are combine and mixed while continuing to flow as a single stream as part of the on-going treatment. Such mixing may also be described as "real time" mixing. According to the present invention, both wet coating and dry coating are acceptable on-the-fly methods of coating the proppant with a curable resin.

The resin on the resin-coated particulates may facilitate the adherence and/or consolidation of a plurality of particulates to form a solid mass, e.g., a proppant pack, after being placed in the well bore and fractures. The resin may be formulated so as to consolidate and/or adhere the plurality of proppant particulates to one another immediately, or it may be formulated such that it becomes "activated" after a certain amount of time or when contacted with another substance, at which point it becomes capable of consolidating and/or adhering the plurality of particulates to one another. The resin-coated particulates may be allowed to consolidate or adhere to one another at any point after the fluid comprising the particulates are introduced to the subterranean formation.

Resins suitable for coating the proppant particulates in certain embodiments of the present invention may include any resin known in the art that is capable of curing into a permeable, consolidated mass. Many such resins are commonly used in subterranean operations, and some suitable resins may include two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. One resin that may be used to coat the proppant particulates is the consolidation agent commercially available from Halliburton Energy Services, Inc. under the trade name EXPEDITE™. Some suitable resins, such as epoxy resins, may be cured with an internal catalyst or activator so that when pumped downhole, they may be cured using only time and/or temperature. Other suitable resins, such as furan resins may require a time-delayed catalyst or an external catalyst to help activate the polymerization of the resins if the cure temperature is low (e.g., less than 250° F.), but may cure under the effect of time and/or temperature if the formation temperature is above about 250° F. By way of further example, selection of a suitable resin may be affected by the temperature of the subterranean formation. For subterranean formations having a bottom hole static temperature ("BHST") ranging from about 300° F. to about 600° F., a furan-based resin may be suitable. For subterranean formations having a BHST ranging from about 200° F. to about 400° F., either a phenolic-based resin or a one-component HT epoxy-based resin may be suitable. For subterranean formations having a BHST of at least about 175° F., a phenol/phenol formaldehyde/furfuryl alcohol resin also may be suitable. It is within the ability of one skilled in the art, with the benefit of this disclosure, to select a suitable resin for use in embodiments of the present invention and to determine whether a catalyst is required to trigger curing.

Figure 2:
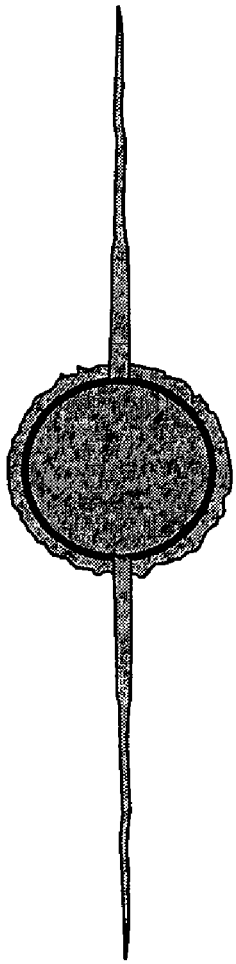
FIG. 2 illustrates a lateral cross section of a well bore with a liner disposed therein, wherein the subterranean formation surrounding the well bore has fractures extending from the well bore into the subterranean formation, and wherein proppant particulates fill the created fractures, the interior of the liner, as well as the annulus between the walls of the well bore and the exterior surface of the liner, in accordance with some embodiments of the present invention.

According to certain embodiments of the present invention, a proppant slurry that comprises resin-coated particulates may be placed in a treatment interval of the well bore so that the particulates fill (e.g., "pack off") at least a portion of the outer annulus and the interior of the liner in the treatment interval. In exemplary embodiments, the proppant slurry is introduced after one or more perforations and/or fractures are created or enhanced in the first region. In some embodiments in which there are fractures that extend from the well bore wall into the subterranean formation, the particulates may also fill at least some portion of one or more of the fractures. In accordance with certain embodiments of the present invention, the proppant slurry is placed in the well bore so that the resin-coated particulates at least partially fill any open spaces in the region of the subterranean formation that is being treated, including the outer annulus, the inner diameter well bore liner, and any fractures in the subterranean formation which originate in the wall of the well bore. According to some embodiments, after the proppant slurry has been placed in a treatment interval, a cross section of the treatment interval and its fractures might show that all of the open spaces in the cross section are filled with particulates, as illustrated in FIG. 2.

According to some embodiments, after at least a portion of the liner and at least a portion of the outer annulus in a treatment interval are at least partially filled with particulates, the jetting tool is then moved uphole to a second treatment interval and the perforating, fracturing, and/or particulate-filling steps described above may be repeated. In some embodiments, the jetting tool may be continually moved uphole as the stimulation fluid, optional fracturing fluid, and/or proppant slurries are placed in the well bore. Optionally, the steps of perforating, optionally fracturing, and at least partially filling a treatment interval with resin-coated particulates may subsequently be repeated in other uphole treatment intervals. In embodiments in which multiple consecutive treatment intervals of the well bore are treated and filled with resin-coated particulates, up to about a 30 foot longitudinal length of the well bore may be filled with resin-coated particulates, both in the outer annular space and inside the liner, and optionally, in fractures that extend into the subterranean formation.

Figure 3:
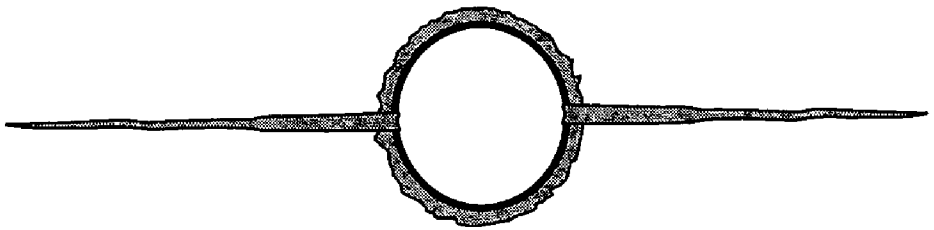
FIG. 3 illustrates the same lateral cross section of the well bore shown in FIG. 2 after a drill has been used to ream out the proppant particulates that were present in the interior of the liner, in accordance with some embodiments of the present invention.
Figure 4:
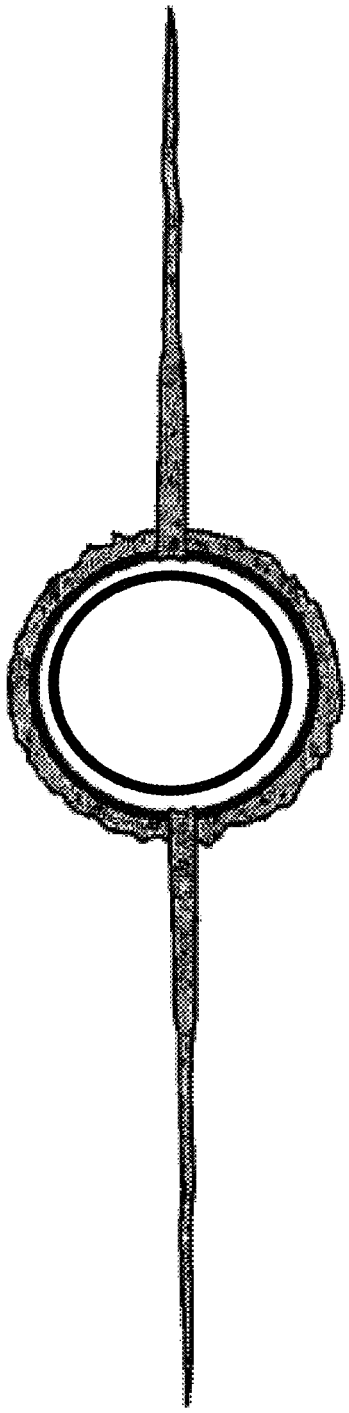
FIG. 4 illustrates the lateral cross section of the well bore shown in FIGS. 2 and 3 with a sleeve inside the liner.

In some embodiments, a drill bit may be introduced to the well bore and used to drill the body of resin-coated particulates located inside the liner. After the drilling step, other spaces in the treated region(s) of the well bore may remain at least partially filled with resin-coated particulates. The resin-coated particulates may, inter alia, serve as a permeable substitute for cement, provide mechanical support along the length of the well bore, prop open fractures, and/or function as a filter to prevent formation fines from entering the well bore with subsequently produced fluids, thereby eliminating the need to install conventional sand control screens and perform subsequent gravel packing treatments. According to some embodiments of the present invention, after a drill has been used to drill through a body of resin-coated particulates located inside the liner, a cross section of any of the treated regions of the subterranean formation might resemble the schematic drawing in FIG. 3.

According to the methods of the present invention, after the resin-coated particulates contained in the proppant slurry are allowed to fill any or all of the spaces of the treated intervals of the well bore, the subterranean formation may be shut in for a period of time to allow the resin to cure, thereby consolidating proppant particulates that are in contactable proximity into one or more proppant packs. The period of time for which the well bore is shut in may depend on the time necessary for the resin to form the proppant packs, which in turn may depend on the type of resin used and the bottomhole temperature of the well. Generally, the resin utilized in the present invention are capable of creating proppant packs relatively quickly, so the shut-in time may range from about 1 hour to about 7 days. Determining the proper period of time to shut in the well bore is within the ability of one skilled in the art with the benefit of this disclosure.

In some embodiments, a stimulation fluid, optional fracturing fluid, and/or proppant slurry used according to the methods of the current invention may further comprise any of a variety of well known additives. For example, one or more of these fluids may comprise at least one additive selected from the group consisting of gelling agents, surfactants, breakers, buffers, a gas phase (if the fracturing fluid is foamed or commingled), coupling agents, crosslinking agents, and the like. In some embodiments, these fluids may also comprise an aqueous or non-aqueous base fluid. Aqueous base fluids may comprise fresh water, salt water, brine, seawater, or a combination thereof. Non-aqueous base fluids may comprise one or more organic liquids, such as hydrocarbons (e.g., kerosene, xylene, toluene, or diesel), oils (e.g., mineral oils or synthetic oils), esters, and the like.

The jetting tool utilized in some embodiments of the methods of the present invention may comprise any device that is capable of increasing or modifying the velocity and/or direction of the flow of a fluid into a subterranean formation from the velocity and/or direction of the flow of that fluid down a well bore. An example of a suitable jetting tool is described in U.S. Pat. No. 5,765,642, the entirety of which is hereby incorporated by reference. Another example of a suitable setting tool is shown in FIGS. 11A and 11B of U.S. Pat. No. 7,225,869, the entirety of which is hereby incorporated by reference.

Briefly, a suitable jetting tool is equipped with a one or more nozzles that are capable of jetting highly pressurized fluid out the jetting tool. In some embodiments, the jetting tool may be rotated, or axially moved, or rotated and axially moved during use, e.g., to cut slots or perforations into the liner and/or formation. Depending on the jetting tool used, using the jetting tool to introduce a fluid into the subterranean formation may comprise, among other things, flowing fluid through the conduit attached to the jetting tool, propelling the fluid through the jetting tool into the subterranean formation at a high rate or speed, propelling the fluid into the subterranean formation in a particular direction, and/or blocking a particular region in the subterranean formation so as to divert the flow of fluid away from that region.

Another aspect of the present invention provides a method comprising providing a liner that comprises sliding sleeves and that is disposed within a well bore that penetrates a subterranean formation, such that the well bore comprises an annular space between the exterior surface of the liner and the well bore wall; shifting a sliding sleeve in a treatment interval of the well bore into an open position so that the interior of the liner is in fluid communication with the annular space through a first set of ports in the liner; introducing a proppant slurry comprising a plurality of resin-coated particulates to the treatment interval of the well bore; and allowing the resin-coated particulates to fill at least a portion of the annular space in the treatment interval.

In general, a liner equipped with sliding sleeves may be a liner that comprises ports that penetrate the wall of the liner and sliding sleeves attached to the interior surface of the liner that may be shifted to cover or un-cover the ports in the liner. Typically, when a sliding sleeve is positioned so that a port in the liner is open (i.e., un-covered by the sliding sleeve), the interior of the liner is in fluid communication with the outer annulus through the port. When a sliding sleeve is positioned so that a port in the liner is closed (i.e., covered by the sliding sleeve), the sliding sleeve creates a barrier to fluid flow.

In general, a liner equipped with sliding sleeves allows treatment fluids to be introduced to specific regions of a well bore by enabling selective opening of the ports in the regions where the operator desires the treatment fluids to be placed. For example, in some embodiments, a liner equipped with sliding sleeves comprises a first sliding sleeve that may shiftably open and/or close a first set of ports. Uphole from the first sliding sleeve, the liner may comprise a second sliding sleeve that may shiftably open and/or close a second set of ports. In general, both the first and second sliding sleeves are initially in a closed position, so that both the first and second set of ports are substantially blocked. Then the first sliding sleeve is shifted into an open position, creating a flow path for a treatment fluid through the first set of ports. Optionally, the first sliding sleeve may then be closed, blocking the flow path through the first set of ports, or the area downhole from the second sliding sleeve may be blocked through another means. The second sliding sleeve may then be shifted into an open position, creating a flow path for a treatment fluid through the second set of ports. By first opening sliding sleeves in the most downhole regions of the well bore and then successively opening sliding sleeves in the more uphole regions of the well bore, successive treatment intervals of the well bore may be isolated for treatment with a treatment fluid.

According to some embodiments of the present invention in which a liner equipped with sliding sleeves is used, a proppant slurry comprising a plurality of resin-coated particulates is introduced through a conduit disposed within the liner, and at least some portion of the proppant slurry enters the outer annulus through an open port of the liner. The conduit may be, for example, coiled tubing. In some embodiments, after the sliding sleeve in one treatment interval has been closed, proppant slurry remaining inside the liner may be removed by way of a conduit, e.g., tubing, before a second set of sliding sleeves are opened, and the process of placing a proppant slurry comprising resin-coated proppant into the fractures and annulus of a next treatment interval is repeated.

In some embodiments in which a liner equipped with sliding sleeves is used, one or more mechanical or swellable packers may be positioned on either or both ends of the liner in order to provide a barrier between an openhole section of the well bore and a section of the well bore that comprises a casing string. Mechanical and swellable packers are well known, and a person of skill in the art will be able to select a packer that is appropriate for a specific operation. In some embodiments, the use of a liner equipped with sliding sleeves may be preferred to the use of liner which must be perforated with a stimulation fluid and/or a jetting tool, because the use of a stimulation fluid and/or a jetting tool might present the risk of undesirably fracturing a water-bearing interval of the formation. In some embodiments, the use of a liner equipped with sliding sleeves might be preferred because, after introducing a fluid comprising resin-coated particulates through ports in the liners, certain ports in the liner may be closed to the influx of water from the formation by shifting the sliding sleeves to a closed position.

Various types of liners equipped with sliding sleeves are known in the art and are acceptable for use in the present invention. One variation that may exist among liners equipped with sliding sleeves that are suitable for use in the present invention is the mechanism utilized to apply the pressure, weight, or tension that shifts the sliding sleeves between the closed and open positions. In some embodiments, liners equipped with sliding sleeves may comprise jets that are incorporated into the sleeve ports. These liners may be used in certain methods of the present invention, for example, in frac-packing applications.

In some embodiments, the sliding sleeves of a liner may be opened through the use of a ball and baffle system. For example, a ball and baffle system may comprise a first sliding sleeve that comprises a baffle that extends into the interior of the liner. A ball of a certain size that is dropped into the liner will catch on the baffle of the first sliding sleeve, pushing the first sliding sleeve so that it shifts in a downhole direction. Typically, this shifting moves the sliding sleeve into an open position, uncovering ports in the liner which are upstream of the lodged ball. At that time, the flow path of least resistance for fluids introduced into the liner is through the opened first set of ports. Subsequently, a second ball may be dropped into liner. The second ball may be larger than the first so that it catches on a smaller baffle that is attached to a second sliding sleeve located uphole of the first sliding sleeve. When the second ball catches on the smaller baffle, it shifts the second sliding sleeve into an open position, uncovering a second set of ports. As a second treatment fluid is introduced into the liner, the second treatment fluid will flow through the second set of ports, but will not flow past the second ball and baffle which form a barrier in the liner.

In some embodiments, the sliding sleeves may be opened through the use of pressure activated sliding sleeves. For example, a first sliding sleeve may be held in a closed position by a first shear pin that is designed to break at a certain pressure. When the pressure in the well bore is increased to the breaking pressure of the first shear pin, the first shear pin breaks, and the first sliding sleeve shifts into an open position, uncovering a first set of ports in the liner. A second sliding sleeve which is uphole of the first sliding sleeve may be held in a closed position by a second shear pin designed to break at a higher pressure. When the pressure in the well bore is increased to the breaking pressure of the second shear pin, the second shear pin breaks, and the second sliding sleeve shifts into an open position.

In some embodiments, the sliding sleeves may be opened through the use of a hydraulic shifting tool attached to a pipe string or coiled tubing. A hydraulic shifting tool may comprise lugs. When hydraulic pressure is applied to the shifting tool, the lugs extend outward into receptacles on a sliding sleeve. As the hydraulic pressure is maintained, the pipe string or coiled tubing to which the hydraulic shifting tool is attached is moved along the longitudinal axis of the well bore, and the lugs pull or push the sliding sleeves into an open or closed position. After the desired shift is accomplished, the hydraulic pressure may be released. In other embodiments, the sliding sleeves may be opened through the use of hydraulic lines that are run outside the liner to the surface. A hydraulic line may be used to apply hydraulic pressure directly to a sliding sleeve, shifting it into an open or closed position.

In certain embodiments in which a liner equipped with sliding sleeves is used, after a region is flooded with a fluid comprising resin-coated proppant particulates, the resin-coated proppant particulates are allowed to pack-off the outer annulus, and optionally, the interior of the well bore liner across the first region, and/or fractures that extend from the well bore into the subterranean formation. In preferred embodiments, the resin-coated proppant particulates are allowed to at least partially consolidate into a proppant pack, as previously described. In certain embodiments, after the resin-coated proppant particulates have filled the desired spaces in the well bore, excess fluid may be recovered. One method of recovering excess fluid may involve washing or reversing out the fluid by circulating a fluid, gas or foam into the well bore. Another alternate method of recovering a proppant slurry that comprises resin-coated particulates may involve pumping out the proppant slurry through a conduit, e.g., a coiled tubing conduit. These methods may be particularly well suited in certain embodiments of the present invention wherein the well bore is highly deviated or horizontal.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by any amount (e.g., 1 percent, 2 percent, 5 percent, or, sometimes, 10 to 20 percent). Whenever a numerical range, R, with a lower limit, RL, and an upper limit, RU, is disclosed, any number falling within the range is specifically disclosed. In particular, the following numbers within the range are specifically disclosed: $R=RL+k*(RU-RL)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A method comprising:

(a) providing a liner disposed within a well bore that penetrates a subterranean formation, such that the well bore comprises an annular space between the exterior surface of the liner and the well bore wall;

(b) providing a jetting tool disposed within the liner;

(c) introducing a stimulation fluid to a treatment interval of the well bore via the jetting tool, such that the stimulation fluid is introduced with sufficient pressure to create or enhance a plurality of perforations in the liner in the treatment interval;

(d) introducing a proppant slurry comprising a plurality of resin-coated particulates to the treatment interval of the well bore; and (e) allowing the resin-coated particulates to fill at least a portion of the liner in the treatment interval and at least a portion of the annular space in the treatment interval;

further comprising moving the jetting tool uphole to a second treatment interval of the well bore and repeating steps (c), (d), and (e) in the second treatment interval.

2. The method of claim 1 further comprising using a drill bit to drill through at least a part of the mass of particulates located in the interior of the well bore liner.

3. The method of claim 1 wherein the resin-coated particulates are at least partially coated in a curable resin.

4. The method of claim 3 further comprising allowing the curable resin that coats the resin-coated particulates to form a proppant pack.

5. The method of claim 1 wherein the proppant slurry is placed in the treatment interval at a pressure sufficient to create or enhance at least one or more fractures in the subterranean formation.

6. The method of claim 1 wherein the step of placing the proppant slurry in the treatment interval of the well bore comprises introducing the proppant slurry to the treatment interval via an inner annulus between the exterior surface of a conduit attached to the jetting tool and the interior surface of the liner.

7. The method of claim 1 wherein the proppant slurry comprises an annulus proppant slurry and a conduit proppant slurry, and wherein the annulus proppant slurry is introduced to the treatment interval via an inner annulus between the exterior surface of the jetting tool and the interior surface of the liner, and the conduit proppant slurry is introduced to the treatment interval via a conduit attached to the jetting tool.

8. The method of claim 7 wherein the conduit fluid comprises resin-coated proppant particulates in an amount of from about 2 to about 4 pounds per gallon of conduit fluid, and wherein the annulus fluid comprises proppant particulates in an amount from about 2 to about 8 pounds per gallon of annulus fluid.

9. The method of claim 1 wherein the stimulation fluid comprises abrasives.

10. The method of claim 1 wherein the well bore liner is centralized with respect to the diameter of the well bore.

11. A method comprising:

(a) providing a liner disposed within a well bore that penetrates a subterranean formation, such that the well bore comprises an annular space between the exterior surface of the liner and the well bore wall;

(b) providing a jetting tool disposed within the liner;

(c) introducing a stimulation fluid to a treatment interval of the well bore via the jetting tool, such that the stimulation fluid is introduced with sufficient pressure to create or enhance a plurality of perforations in the liner in the treatment interval;

(d) introducing a proppant slurry comprising a plurality of resin-coated particulates to the treatment interval of the well bore;

(e) allowing the resin-coated particulates to fill at least a portion of the liner in the treatment interval and at least a portion of the annular space in the treatment interval;

(f) allowing the resin-coated proppant particulates in the interior of the liner to at least partially consolidate into a proppant pack; and (g) using a drill bit to drill through the resin-coated proppant particulates in the interior of the liner.

12. The method of claim 11 wherein the step of placing the proppant slurry in the treatment interval of the well bore comprises introducing the proppant slurry to the treatment interval via an inner annulus between the exterior surface of a conduit attached to the jetting tool and the interior surface of the liner.

13. The method of claim 11 wherein the proppant slurry comprises an annulus proppant slurry and a conduit proppant slurry, and wherein the annulus proppant slurry is introduced to the treatment interval via an inner annulus between the exterior surface of the jetting tool and the interior surface of the liner, and the conduit proppant slurry is introduced to the treatment interval via a conduit attached to the jetting tool.

14. The method of claim 13 wherein the conduit fluid comprises resin-coated proppant particulates in an amount of from about 2 to about 4 pounds per gallon of conduit fluid, and wherein the annulus fluid comprises proppant particulates in an amount from about 2 to about 8 pounds per gallon of annulus fluid.

15. The method of claim 11 wherein the stimulation fluid comprises abrasives.

16. The method of claim 11 wherein the well bore liner is centralized with respect to the diameter of the well bore.

17. A method comprising:

(a) providing a liner that comprises sliding sleeves and that is disposed within a well bore that penetrates a subterranean formation, such that the well bore comprises an annular space between the exterior surface of the liner and the well bore wall;

(b) shifting a sliding sleeve in a treatment interval of the well bore into an open position so that the interior of the liner is in fluid communication with the annular space through a first set of ports in the liner;

(c) introducing a proppant slurry comprising a plurality of resin-coated particulates to the treatment interval of the well bore; and (d) allowing the resin-coated particulates to fill at least a portion of the liner in the treatment interval and at least a portion of the annular space in the treatment interval;

further comprising, after allowing the resin-coated particulates to fill at least a portion of the liner in the treatment interval and at least a portion of the annular space in the treatment interval, shifting the sliding sleeve in the treatment interval to a closed position and removing at least a portion of the resin-coated particulates in the liner via a conduit disposed in the liner.

18. The method of claim 17 further comprising after removing at least a portion of the resin-coated particulates in the liner via a conduit disposed in the liner, shifting a sliding sleeve on the liner in a second treatment interval to an open position so that the interior of the liner is in fluid communication with the annular space through a second set of ports in the liner, introducing a proppant slurry comprising a plurality of resin-coated particulates to the second treatment interval, and allowing the resin-coated particulates to fill at least a portion of the liner in the treatment interval and at least a portion of the annular space in the treatment interval.

* * * * *